US006783726B2

(12) United States Patent
Polvi

(10) Patent No.: US 6,783,726 B2
(45) Date of Patent: Aug. 31, 2004

(54) COOLING ELEMENT AND METHOD FOR MANUFACTURING COOLING ELEMENTS

(75) Inventor: Veikki Polvi, Pori (FI)

(73) Assignee: Outokumpa Oyj, Espoo (FI)

( * ) Notice: Subject to any disclaimer, the term of this patent is extended or adjusted under 35 U.S.C. 154(b) by 66 days.

(21) Appl. No.: 10/203,847

(22) PCT Filed: Feb. 21, 2001

(86) PCT No.: PCT/FI01/00168

§ 371 (c)(1),
(2), (4) Date: Aug. 14, 2002

(87) PCT Pub. No.: WO01/63192

PCT Pub. Date: Aug. 30, 2001

(65) Prior Publication Data

US 2003/0020215 A1 Jan. 30, 2003

(30) Foreign Application Priority Data

Feb. 23, 2000 (FI) ..... 000410

(51) Int. Cl.[7] ..... C21B 7/10
(52) U.S. Cl. ..... 266/193; 266/194; 122/6 A
(58) Field of Search ..... 266/193, 194, 266/195, 196; 122/6 A, 6 B

(56) References Cited

U.S. PATENT DOCUMENTS

| | | | |
|---|---|---|---|
| 3,849,587 A | 11/1974 | Hatch et al. | |
| 5,465,484 A | 11/1995 | Banks et al. | |
| 5,741,349 A | 4/1998 | Hubble et al. | |

FOREIGN PATENT DOCUMENTS

| | | | | |
|---|---|---|---|---|
| DE | 42 04 449 A1 | | 8/1992 | |
| GB | 2 122 926 A | | 1/1989 | |
| JP | 58147504 A | * | 9/1983 | ..... 428/652 |
| JP | 58147505 A | * | 9/1983 | ..... 266/193 |
| JP | 59043804 A | * | 3/1984 | ..... 428/627 |

OTHER PUBLICATIONS

Derwent World Patent Index English language abstract–of–JP 58147504 A.

* cited by examiner

*Primary Examiner*—Scott Kastler
(74) *Attorney, Agent, or Firm*—Morgan & Finnegan, LLP

(57) ABSTRACT

A cooling element designed particularly for furnaces, said element comprising a housing (1) mainly made of copper, and a channel system (6) provided in the housing for cooling medium circulation. At least on a part of the surface of the element housing (1), there is arranged, by means of a diffusion joint, a corrosion-resistant surface layer (2). The invention also relates to a method for arranging said surface layer in the cooling element.

13 Claims, 2 Drawing Sheets

COOLING ELEMENT AND METHOD FOR MANUFACTURING COOLING ELEMENTS

The present invention relates to a cooling element designed particularly for furnaces. The invention also relates to a method for manufacturing cooling elements.

In connection with industrial furnaces, such as flash smelting furnaces, blast furnaces and electric furnaces, there are used massive cooling elements that are typically made of copper. They are used in extreme working conditions, where copper is subjected to intensive corrosion strains caused by the furnace atmosphere and even by contacts with the molten material. For example, in an $SO_2$ atmosphere, copper corrosion is caused, among others, by oxidizing and sulphatizing reactions, which in the worst case can result in material losses of even tens of millimeters on the corroded surfaces.

The object of the invention is to realize a cooling element whereby the problems known in the prior art can be avoided. Thus the object of the invention also is to achieve a cooling element that has a longer working life than the ones known in the prior art. Another object of the invention is to realize a method for manufacturing a cooling element that is more resistant than the ones known in the prior art.

The invention is based on an idea according to which on the surface of a cooled element consisting mainly of copper there is attached, by means of a diffusion joint, a steel surface that has a better corrosion resistance.

The invention is characterized by what is specified in the appended claims.

The invention has several remarkable advantages. The method of applying a surface layer by means of a diffusion joint enables an excellent heat transfer over the junction. The suggested joining method allows the surface layer to be joined to the cooling element housing at temperatures that are even hundreds of degrees lower than the melting point of copper. The cooling element according to the invention has a remarkably better corrosion resistance than the cooling elements of the prior art. Consequently their working life before replacement is remarkably longer than in the prior art.

In this application, the term copper refers to, apart from objects made of copper, also to alloy materials with a copper content that essentially includes at least 50% copper. The term stainless steel in this application refers mainly to austenitic alloy steels, such as stainless and acid-proof steels.

Figure 1:
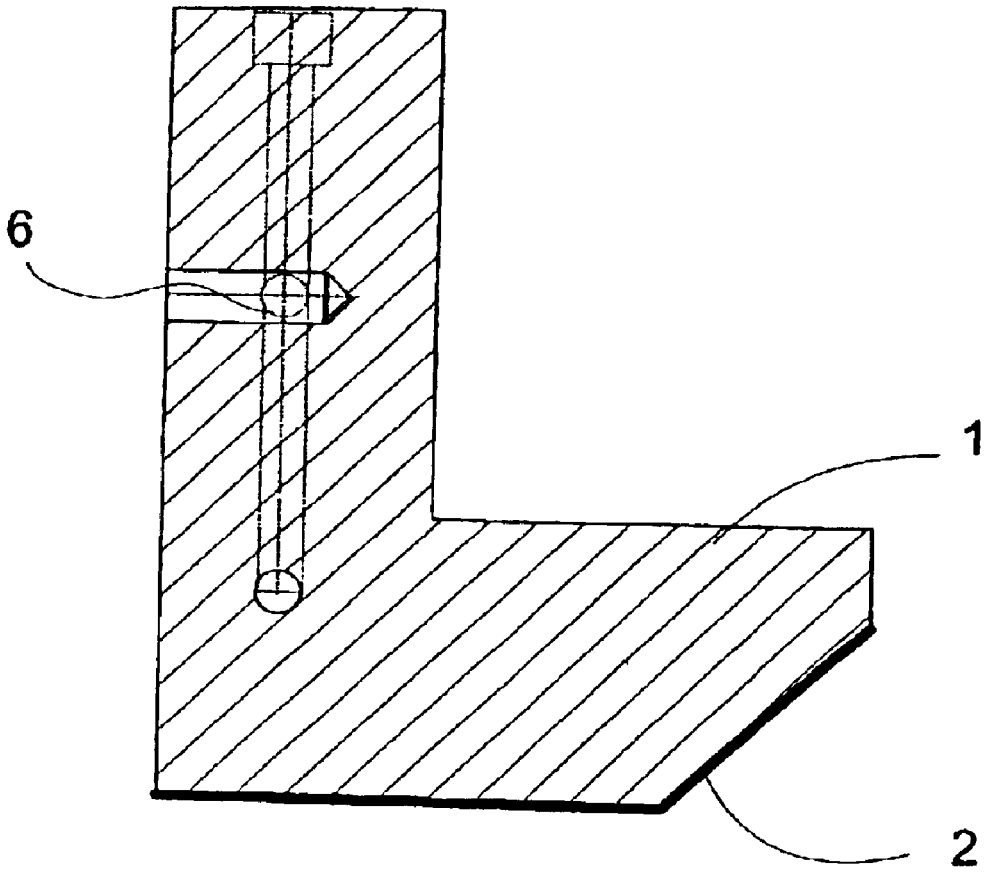
Figure 2:
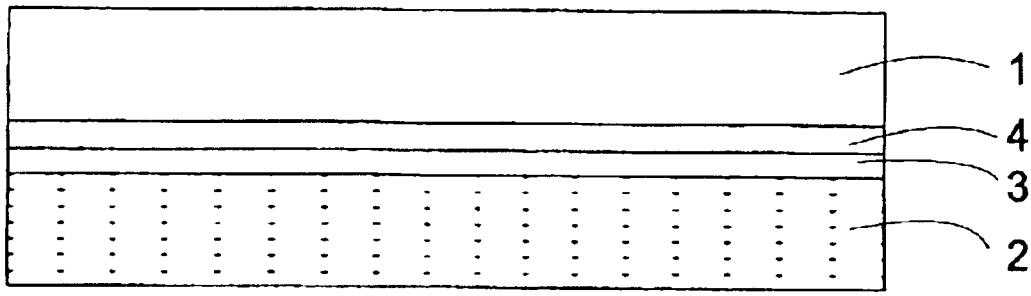
Figure 3:
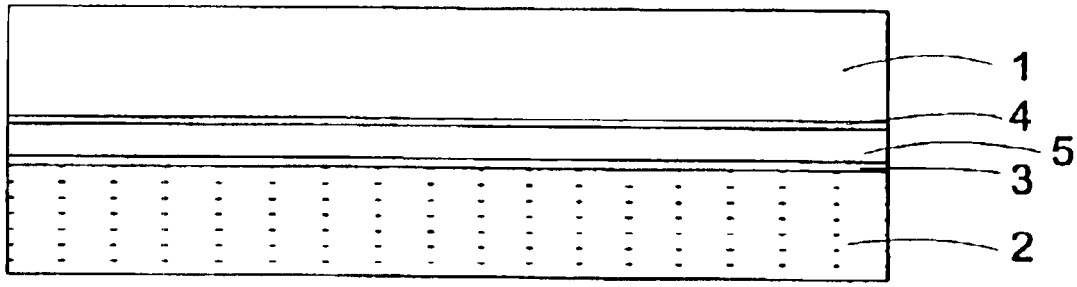
Figure 4:
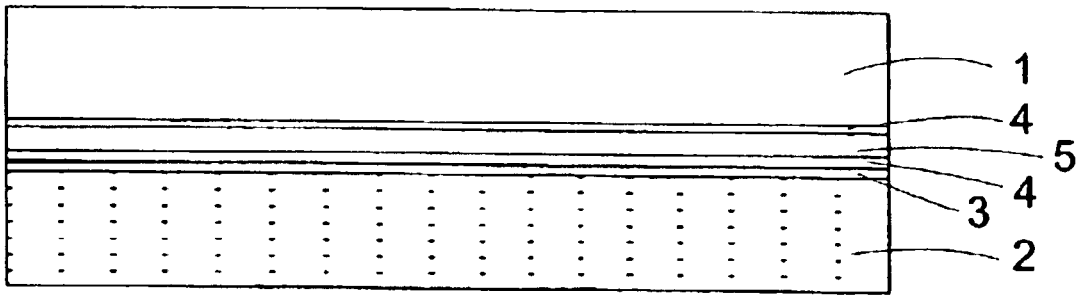

The invention is explained in more detail with reference to the appended drawings, where FIG. 1 illustrates a cooling element according to the invention in cross-section, FIG. 2 illustrates the junction according to the method of the invention in a simplified cross-section prior to heating, FIG. 3 illustrates another junction according to the method of the invention in a simplified cross-section prior to heating, and FIG. 4 illustrates a third junction according to the method of the invention in a simplified cross-section prior to heating.

FIG. 1 illustrates in cross-section a cooling element used particularly in furnaces. The element comprises a housing 1 mainly made of copper or copper alloy and provided with a cooling channel system 6 for cooling medium circulation. According to the invention, at least in a part of the surface of the cooling element housing 1, there is arranged, by means of a diffusion joint, a corrosion-resistant surface layer 2. Said surface layer 2 is made of steel, particularly refined steel. Typically the steel is for example acid-proof steel. The surface layer 2 is applied only on a part of the surface of the element housing 1. The cooling element illustrated in FIG. 1 is a cooling element of a flash smelting furnace. Naturally the cooling element may belong to another type of furnace, particularly a furnace that is used in the manufacturing or refining of metals. The shape and size of the cooling element is dependent on the particular target of usage in each case. A preferred embodiment according to the invention is that the element is a cooled element, a so-called chute element, particularly used in conducting melt. In that case the surface layer can be arranged for instance in that part of the surface where it gets into contact with the melt.

According to the method of the invention, the surface layer 2 is attached, by means of a diffusion joint, to the element housing 1. In between the junction surfaces of the surface layer 2 and the housing 1, there is provided at least one intermediate layer 3, 4, 5 prior to forming the joint. The employed surface layer 2 is steel, particularly refined steel.

FIG. 2 illustrates an embodiment of the joining method according to the invention in cross-section prior to the thermal treatment. A housing 1 essentially consisting mainly of copper, and a surface layer 2 consisting of refined steel, for example austenitic stainless steel, are thereby joined together. In the junction between the two objects, there are arranged intermediate layers 3, 4. The first intermediate layer 3 placed against the surface layer 2, which layer is mainly designed for preventing the nickel loss from steel, typically includes mainly nickel (Ni). In addition, when creating the joint, there is advantageously used at least a second intermediate layer 4, i.e. a so-called activator layer, which in the case of the example is for instance tin (Sn). Tin functions as the activator and results in a lowering of the temperature, which is required in the creation of the joint.

The first intermediate layer 3 can be formed on the surface layer surface by means of a separate treatment. When nickel is used as the first intermediate layer 3, said layer can be created on the surface layer surface for example by means of electrolysis. Nickel-plating is typically carried out so that the passivation layer provided on the stainless steel surface does not present an obstacle to the material transfer on the junction surface between stainless steel and nickel. The first intermediate layer 3 can also exist in the form of foil.

In the method according to the invention, in between the junction surfaces of the surface layer 2 and the cooling element housing 1, to be joined together, there is provided a first intermediate layer 3 on the junction surface of the surface layer 2 or against said surface, and a second intermediate layer 4 on the junction surface of the housing 1 or against said surface, so that the junction surfaces including their intermediate layers 3, 4 are pressed together, and in said method, at least the junction area is heated. The first intermediate layer 3 may include mainly nickel (Ni) or chromium (Cr), or an alloy or mixture thereof. The second intermediate layer 4 consists of an activator with a melting temperature that is lower than that of the objects that should be joined together. The second intermediate layer 4 includes mainly silver (Ag) and/or tin (Sn), or, as an alloy or mixture, silver and copper (Ag+Cu), aluminum and copper (Al+Cu) or tin and copper (Sn+Cu).

When heating the junction area, there is created a diffusion joint on the surfaces of the objects to be joined together; this takes place as a result of the nickel diffusion on one hand, and as a result of the diffusion of the copper and steel components on the other. The forming of the diffusion joint, and the structures created therein, are activated by means of an extremely thin second intermediate layer 4, i.e. the soldering agent layer, required by the applied manufacturing conditions and the desired joint, or by means of a mixture of several intermediate layers 4, 5 placed on the junction surface between the nickel-plated surface layer 2 and the housing 1.

The employed soldering agents and diffusion activators of the intermediate layers 4, 5 can be silver-copper alloys and tin in pure form or in specific sandwich structures. Mechanically strong joints are obtained within the temperature range of 600–850° C. The selection of thermal treatment periods can be carried out so that the creation of brittle intermetallic phases in the final joint are avoided. The soldering agent thicknesses, as well as the thermal treatment temperature and duration of the intermediate layers, are chosen so that the nickel loss from steel is prevented as a result of the alloy with a high nickel content provided on the surface thereof. An advantage of a low joining temperature is that the thermal stresses created in the junction area are minimal.

FIG. 3 illustrates a preferred embodiment of the method according to the invention. There at least a second intermediate layer 4 and at least a third intermediate layer 5 is provided, and the melting temperature of the second intermediate layer 4 is lower than that of the third intermediate layer 5. The third intermediate layer 4 consists mainly of silver (Ag) or of both silver (Ag) and copper (Cu), either as an alloy or in a mixture. In a preferred embodiment, the third intermediate layer consists of an Ag+Cu soldering agent, advantageously in the form of foil. According to a preferred embodiment, the second intermediate layer includes, in percentages by weight, Ag 71% and Cu 29%. Advantageously the soldering agent has, with a given alloy composition, a eutectic composition with copper. The junction area is heated in one step. According to a preferred embodiment of the method according to the invention, the second intermediate layer 4 is brought onto the surface of the third intermediate layer 5. Typically, but not necessarily, at least one of the intermediate layers 3, 4, 5 is brought to the junction area in the form of foil. The employed soldering agents and diffusion activators of the intermediate layers 4, 5 can be silver-copper alloys and tin, either in a pure form or as specific sandwich structures. Mechanically strong joints are obtained within the temperature range of 600–850° C. The selection of thermal treatment periods can be carried out so that the creation of brittle intermetallic phases in the final joint are avoided. The soldering agent thicknesses, as well as the thermal treatment temperature and duration are chosen so that the nickel loss from steel is prevented as a result of the alloy with a high nickel content provided on the surface thereof. An advantage of a low joining temperature is that the thermal stresses created in the junction area are minimal.

FIG. 4 illustrates yet another embodiment of the method according to the invention prior to heating the surface layer and the housing joint. There a second intermediate layer 4 is provided on both surfaces of the third intermediate layer 5, or against said surfaces. In this embodiment, there can typically be used a sandwich foil, where one or both surfaces of the foil are treated for instance with tin.

The thicknesses of the intermediate layers used in the method vary. The thickness of the Ni layer employed as the first intermediate layer 3 is typically 2–50 μm. After electrolysis, it is typically 2–10 μm, as a foil of the order 20–50 μm. The thickness of the Ag or Ag+Cu foil employed as the third intermediate layer 5 is typically 10–500 μm, preferably 20–100 μm. The thickness of the second intermediate layer 4 is typically dependent on the thickness of the third intermediate layer 5, and is for instance 10–50% of the thickness of the third intermediate layer. Extremely high-quality joints have been achieved by applying for instance a 5–10 μm tin layer on the surfaces of a 50 μm thick Ag+Cu soldering agent foil. The tin layers can be formed for example by immersing the soldering agent in the form of foil in molten tin, and when necessary, by thereafter rolling the foil to be smooth.

The selected material for the surface layer can be the most suitable type of steel.

EXAMPLE I

Acid-proof steel (AISI 316) and copper (Cu) were joined together. On the steel junction surface, there was provided, as a first intermediate layer, a nickel (Ni) layer with the thickness of 7 μm. As a diffusion activator and soldering agent, there was used an Ag+Cu soldering agent having a eutectic composition, including in percentages by weight 71% Ag and 29% Cu. The soldering agent was in the form of foil with the thickness of 50 μm, and on the foil surface there was also formed a tin (Sn) layer with a thickness of the order 5–10 μm. The objects to be joined together were placed against each other, so that the foil was left in between the junction surfaces. The objects were pressed together, and the junction area was heated above the melting temperature of the soldering agent, up to a temperature of about 800° C. The holding time was about 10 minutes. The junction according to the example succeeded excellently. The obtained result was a metallurgically compact joint.

What is claimed is:

1. A cooling element designed particularly for furnaces, said element comprising a housing mainly made of copper, and a channel system provided in the housing for cooling medium circulation, wherein at least in part of the surface of the element housing, there is arranged, by means of a diffusion joint, a corrosion-resistant surface layer, made of steel.

2. A cooling element according to claim 1, wherein the surface layer is provided only on part of the surface of the element housing.

3. A cooling element according to claim 1, wherein steel is acid-proof steel.

4. A cooling element according to claim 1, wherein the steel is stainless steel.

5. A method for arranging a corrosion-resistant surface layer in a cooling element consisting mainly of copper, wherein the surface layer, made of steel, is attached to the element housing by means of a diffusion joint and that in between the surface layer and the junction surfaces of the housing, there is arranged at least one intermediate layer consisting mainly of nickel (Ni) or chromium (Cr) or of an alloy or mixture thereof prior to creating the joint.

6. A method according to claim 5, wherein in between the surface layer and the junction surfaces of the cooling element housing, to be joined together, there is arranged a first intermediate layer on the junction surface of the surface layer or against said surface, and a second intermediate layer on the junction surface of the housing or against said surface, so that the junction surfaces including their intermediate layers are pressed together, and in which method at least the junction area is heated.

7. A method according to claim 5, wherein the second intermediate layer consists of an activator with a melting temperature that is lower than the melting temperature of the objects to be joined together.

8. A method according to claim 5, wherein the second intermediate layer consists mainly of silver (Ag) and/or tin (Sn), or as an alloy or in a mixture, silver and copper (Ag+Cu), aluminum and copper (AI+Cu) or tin and copper (Sn+Cu).

9. A method according to claim 5, wherein there is brought at least a second intermediate layer and at least a third intermediate layer, and that the melting temperature of the second intermediate layer is lower than that of the third intermediate layer.

10. A method according to claim 5, wherein the third intermediate layer consists mainly of silver (Ag) or of silver (Ag) and copper (Cu) either as an alloy or in a mixture.

11. A method according to claim 5, wherein the junction area is heated in one step.

12. A method according to claim 5, wherein the second intermediate layer is brought on the surface of the third intermediate layer.

13. A method according to claim 5, wherein at least one of the intermediate layers is brought to the junction area in the form of foil.

* * * * *